US005873277A

United States Patent [19]

Bruestle

[11] Patent Number: 5,873,277

[45] Date of Patent: Feb. 23, 1999

[54] CONTROL PROCESS FOR A ROLL STAND FOR ROLLING A STRIP

[75] Inventor: Roland Bruestle, Neunkirchen, Germany

[73] Assignee: Siemens Aktiengesellschaft, München, Germany

[21] Appl. No.: 853,140

[22] Filed: May 8, 1997

[30] Foreign Application Priority Data

Nov. 13, 1996 [DE] Germany ..... 196 18 712.5

[51] Int. Cl.[6] ..... B21B 37/00

[52] U.S. Cl. ..... 72/7.4; 72/8.6; 72/11.4; 72/12.3

[58] Field of Search ..... 72/7.1, 7.2, 7.3, 72/7.4, 7.6, 8.3, 8.6, 8.7, 9.5, 10.1, 10.4, 10.7, 11.1, 11.4, 12.3, 234, 242.4, 247, 248

[56] References Cited

U.S. PATENT DOCUMENTS

| | | | |
|---|---|---|---|
| 4,691,547 | 9/1987 | Teoh et al. . | |
| 4,773,246 | 9/1988 | Perret | 72/10.1 |
| 5,353,217 | 10/1994 | Berghs et al. . | |
| 5,357,421 | 10/1994 | Tautz et al. . | |
| 5,461,894 | 10/1995 | Sorgel . | |
| 5,502,992 | 4/1996 | Sorgel et al. . | |
| 5,513,097 | 4/1996 | Gramckow et al. . | |
| 5,520,037 | 5/1996 | Sorgel . | |
| 5,586,221 | 12/1996 | Isik et al. . | |
| 5,592,846 | 1/1997 | Watanabe et al. | 72/247 |
| 5,598,329 | 1/1997 | Niemann . | |
| 5,600,758 | 2/1997 | Broese et al. . | |
| 5,600,982 | 2/1997 | Berger . | |
| 5,622,073 | 4/1997 | Hiruta et al. | 72/247 |
| 5,740,686 | 4/1998 | Martinetz et al. | 72/8.4 |

FOREIGN PATENT DOCUMENTS

| | | | |
|---|---|---|---|
| 0 575 636 | 12/1993 | European Pat. Off. . | |
| 19505694 | 7/1996 | Germany . | |
| 56-160819 | 12/1981 | Japan . | |
| 2-117709 | 5/1990 | Japan | 72/10.4 |
| 6-262224 | 9/1994 | Japan | 72/10.4 |

OTHER PUBLICATIONS

Hishikawa et al., "New Control Techniques for Cold Rolling Mills—Applications to Aluminum Rolling—", Hitachi Review vol. 39, (1990), No. 4, pp. 221–230.

*Primary Examiner*—Joseph J. Hail, III
*Assistant Examiner*—Ed Tolan
*Attorney, Agent, or Firm*—Kenyon & Kenyon

[57] ABSTRACT

The invention relates to a control process for a roll stand consisting of a pair of work rolls, a pair of backup rolls, and optionally a pair of intermediary rolls. The controls for a rolling force, a deflecting force, and optionally a roll shift are given specified values, which are obtained on-line in a roll stand model with a roll deflection model. According to the invention, relationships between the rolling force, the deflecting force, and the roll shift, on the one hand, and a corresponding roll gap variation on the other hand are determined on line in the roll deflection model at interpolation points. These relationships are used to calculate at the interpolation points set points for the rolling force, the deflecting force, and the roll shift.

14 Claims, 3 Drawing Sheets

CONTROL PROCESS FOR A ROLL STAND FOR ROLLING A STRIP

BACKGROUND OF THE INVENTION

The present invention is directed to a control process for a roll stand for rolling a strip, and in particular to a four-high or a six-high stand having at least one pair of work rolls and one pair of backup rolls, both mounted on roll bearings. As an option, the stand may include one pair of intermediary rolls, also mounted on roll bearings. The present invention is directed to a control process for roll stands of the type having controls for a rolling force, for a deflecting force, and, as an option, for a roll shift. The roll stand also includes a roll stand model with a deflection model, in which the roll stand model is assigned a specified roll gap variation, and the roll stand model calculates from the specified roll gap variation a plurality of on line set points for the rolling force, for the deflecting force, and, optionally, for the roll shift.

Control processes for roll stands in general are in wide use. The differential equations for calculating the deflection and the variation of forces during a rolling operation, as well as the solutions of these differential equations, are well known in principle. The solution algorithms used, however, converge very slowly. Therefore, they cannot be used on-line. For this reason, tables have been calculated for obtaining, through interpolation, the relationship between on the one hand the rolling force and the deflecting force and, optionally, the roll shift, and on the other hand the roll gap variation. Use of such tables, however, has proven extremely rigid and inflexible, particularly when individual rolls of the roll stand are replaced, because in that situation the tables must be completely recalculated.

SUMMARY OF THE INVENTION

Accordingly, an object of the present invention is to provide a simple way, usable on-line, to calculate set points for the rolling force, the deflecting force, and, optionally, the roll shift.

This object of the present invention is achieved by calculating on line in the deflection model the relationships at interpolation points between on the one hand the rolling force and the deflecting force, and optionally, the roll shift, and on the other hand a corresponding roll gap variation.

The number of interpolation points can be predefined as a function of the available computing capacity, so that the algorithm can be matched to the available computing capacity within certain limits.

The process according to the present invention may be implemented by first establishing a number of interpolation points along the roll axis of each roll, in which the interpolation points of all the rolls are arranged in the same axial position. Then, a local force is obtained at each interpolation point of each roll; the sum of the local forces at the interpolation points of a particular roll is equal to an outside force acting on the bearings of that roll. The local forces of each roll are used to calculate a deflection at each interpolation point of each roll. The deflections are used to calculate a correction value for the local forces of neighboring rolls at the same interpolation point, for example by using the difference in deflections of neighboring rolls at the same interpolation point.

Of course, the roll flattening that occurs is also taken into consideration when calculating the correction values.

The solution algorithm converges particularly rapidly if the correction values have a component that is independent of the interpolation point, and if the component that is independent of the interpolation point is of such a magnitude that the sum of the correction values for each roll is zero.

If the strip to be rolled is asymmetric in relation to the center of the roll, a symmetrical force distribution must be applied to the rolls. The resulting stable state is distinguished by the fact that the total moment in relation to the center of the strip is zero. The control process is therefore adjusted in the following manner. Local moments are calculated by multiplying each local force at each interpolation point of each roll by the offset of its interpolation point in relation to the center of the strip. The correction values preferably have a linear component that is antisymmetric in relation to the center of the strip, which antisymmetric component is calculated to have a magnitude such that the sum of the local moments is zero for each roll.

A function is called antisymmetric when changing the sign of its input values results in a change in the sign of the function value. Such antisymmetric functions include, for example, polynomials of the nth order where n is an odd number, such as a linear or a cubic function, and the sine function, or any combination of these functions.

The solution algorithm converges even faster if the residual correction value remaining after deduction of the component that is independent of the interpolation point and optionally also of the antisymmetric component consists of a gain factor and a deflection-independent function value, and if an optimized gain factor is calculated from the differences of the deflections of successive iterations.

Due to the fact that the deflection model can be used on-line, the forces obtained on-line to arrive at the specified roll gap variation in the roll stand model, such as the rolling force and the deflecting force, as well as the calculated roll shift, can be supplied as inputs to an on-line temperature model and/or an on-line wear model, where the temperature-related or wear-related deformations of the rolls are calculated.

The temperature model and the wear model are known in principle. They could not, however, be used on-line previously, since the deflection model supplying the input data for the temperature model and the wear model could not be previously used on-line.

The accuracy of the deflection model is increased if the temperature-related and/or the wear-related deformations of the rolls are supplied again to the roll deflection model as inputs. No stability problems arise in this case, since while the deflection model immediately acts upon the temperature model and the wear model, the reverse action of the temperature model and the wear model on the deflection model is subject to a delay.

In order to ensure the planarity of the rolled strip, the forces may be corrected in accordance with measured values from the roll stand. For example, the distribution of the front tension across the strip may be determined. Then a corrected specified rolling force and a corrected specified deflecting force and, optionally, a corrected specified roll shift, are determined from the front tension distribution. Finally, the corrected values are supplied to the rolling force, deflecting force, and optionally roll shift controls as specified values.

The deflection model, the temperature model, and the wear model may be designed as self-adapting models. The following steps may be used for model adaptation. The profile of the rolled strip is determined during rolling, e.g., via the front tension distribution across the strip, and therefrom an actual roll gap variation is determined. The actual roll gap variation is compared with the specified roll gap variation. In order to adapt the model to the actual characteristics of the roll stand, adaptation parameters for the deflection, temperature, and wear models are determined from the deviation between the actual and specified roll gap variation. The adaptation parameters for the roll deflection model are determined immediately after the startup of the roll stand. After the roll deflection adaption parameters are determined, then the adaptation parameters for the temperature model and the adaptation parameters for the wear model are determined.

Thus, all three models can be adapted, although only one variable is available, namely, the front tension distribution.

DETAILED DESCRIPTION OF THE DRAWINGS

Figure 1:
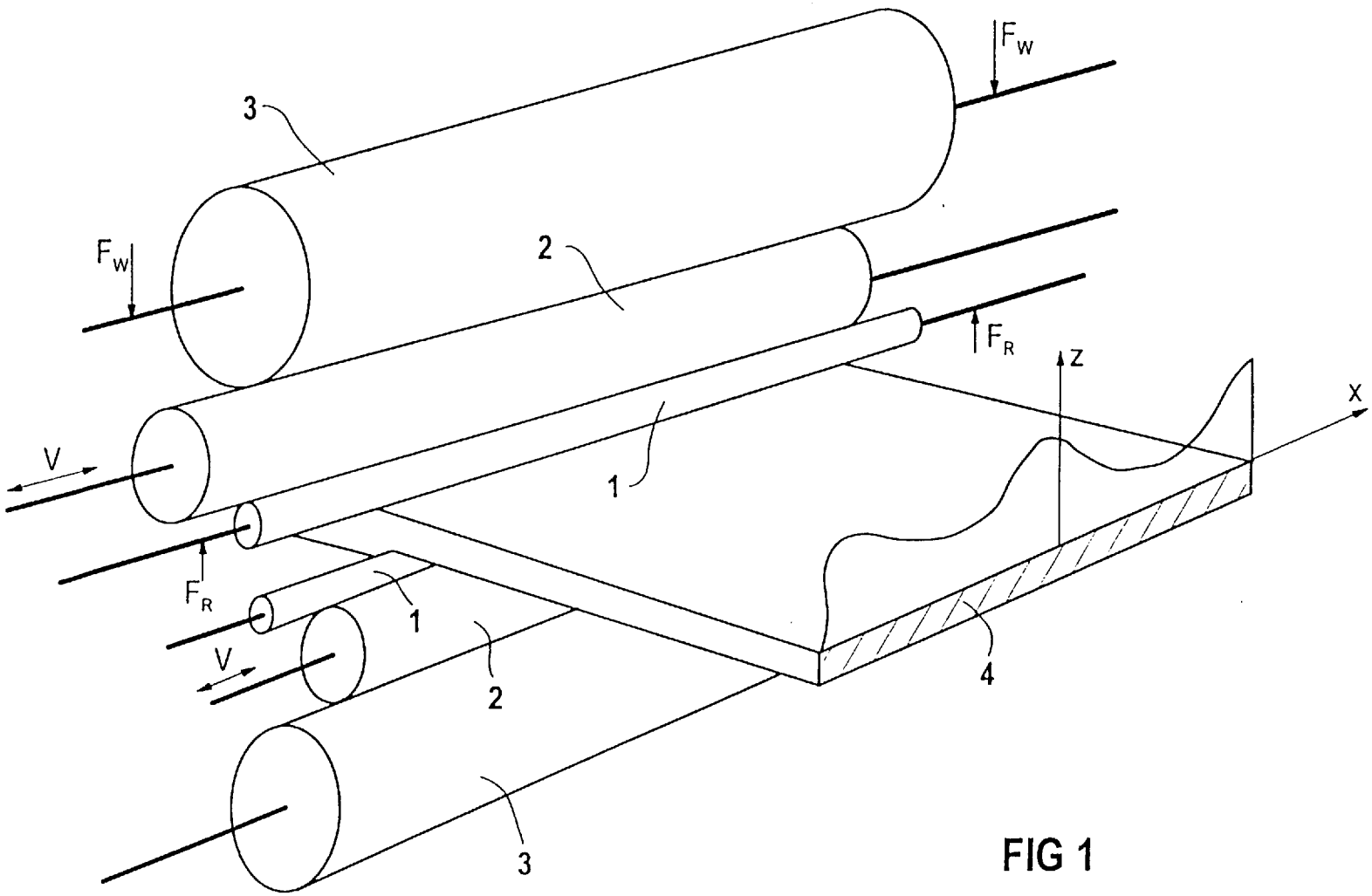
FIG. 1 is a perspective schematic illustration of a roll stand constructed according to the principles of the invention.

According to FIG. 1, the stand of a rolling mill comprises work rolls 1, intermediary rolls 2, and backup rolls 3. Rolls 1 through 3 are mounted on bearings (not illustrated). Forces can be exerted upon rolls 1 through 3 via the roll bearings. The roll gap that deforms rolled stock 4 is determined by rolling force $F_w$ acting upon backup rolls 3, deflecting force $F_R$ acting upon work rolls 1, and axial shift V of intermediary rolls 2.

On the output side, the variation of front tension Z(x) across the strip width x is measured on the roll stand using a front tension measuring device (not illustrated in FIG. 1), so that conclusions can be drawn regarding the strip profile and the roll gap variation. The point x=0 is always taken at the center of the strip.

Figure 2:
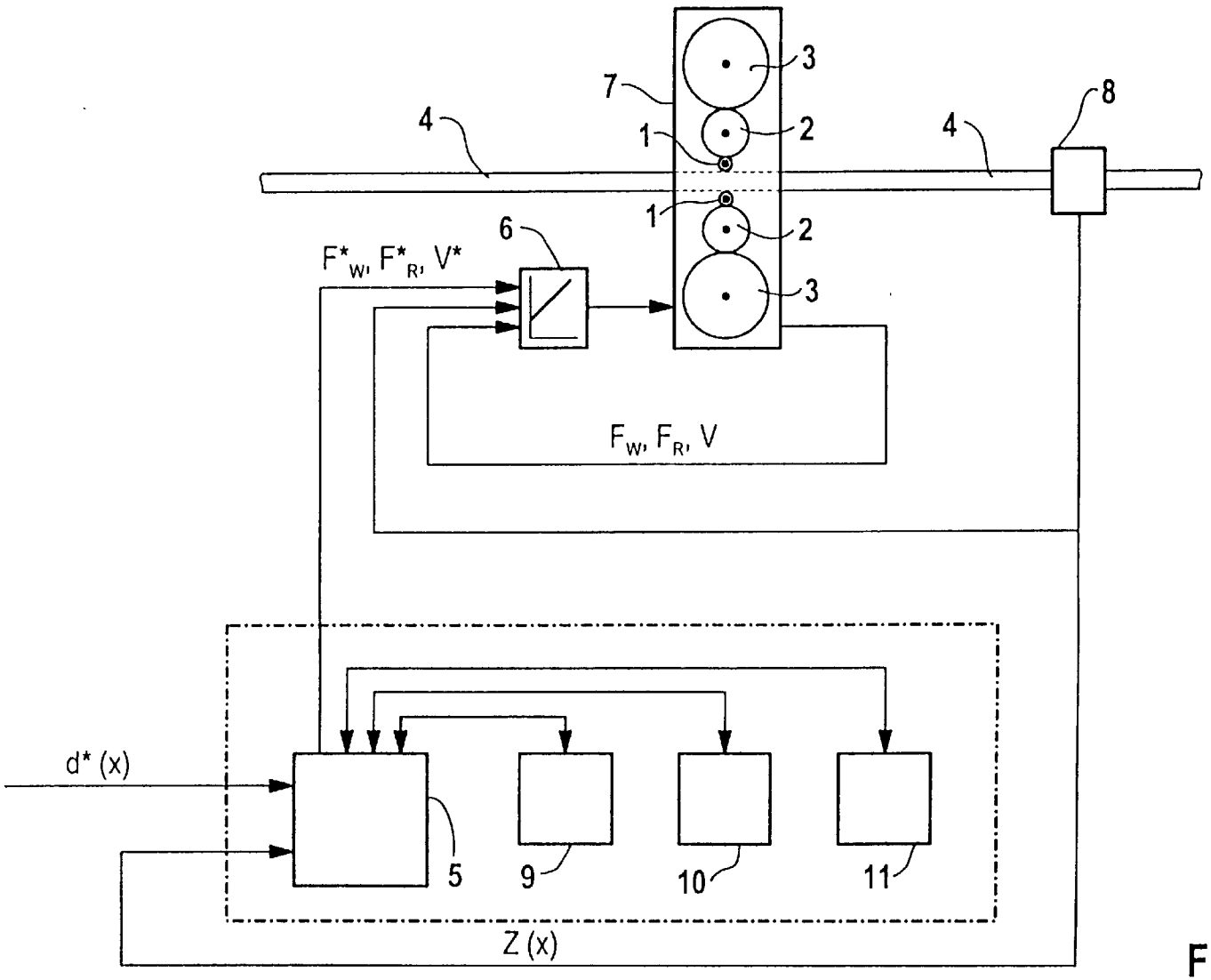
FIG. 2 is a block diagram of a control structure of a roll stand.

According to FIG. 2, in order to roll strip 4, a specified rolled strip profile d*(x) is defined for the roll stand model 5. Specified values $F_w$*, $F_R$*, and V* are then determined on-line for the rolling force, deflecting force, and roll shift, respectively, in roll stand model 5. These specified values are supplied to underlying control device 6, which controls the rolling force $F_w$, the deflecting force $F_R$, and the roll shift V according to the predefined specified values $F_w$*, $F_R$*, and V*.

A tension measuring device 8, which measures the front tension variation Z(x) across strip width x is located behind roll stand 7. Tension measuring device 8 can comprise a set of tension measuring rolls, for example. By using the tension variation Z(x) and the strip thickness variation (i.e., the actual profile d(x)), the roll gap variation can be calculated as well.

As the relationships between tension variations and roll gap variations, as well as those between roll gap variations and deflecting force variations, are well-known, the corrected values for the specified rolling force $F_w$*, the specified deflecting force $F_R$*, and the specified roll shift V* can be calculated in roll stand model 5 from the tension distribution Z(x). The specified values $F_w$*, $F_R$*, and V* thus corrected are then supplied to control device 6, in order to eliminate the strip defects that appear.

The measured tension variation Z(x) is also used for adapting roll stand model 5 in a manner to be explained later.

To calculate the specified roll gap variation between work rolls 1 in roll stand model 5, a plurality of combinations of rolling force $F_w$, deflecting force $F_R$ and roll shift V are supplied to a roll deflection model 9. Relationships between rolling force $F_w$, deflecting force $F_R$, and roll shift V on the one hand, and the resulting expected roll gap variation on the other hand are determined on line at the interpolation points in roll deflection model 9 in a manner to be explained later. The roll gap variation thus obtained is fed back to roll stand model 5.

The combinations of rolling force $F_w$, deflecting force $F_R$, and roll shift V supplied to roll deflection model 9 are normally a basic combination plus three derived combinations. In each derived combination, one of the three possible variables $F_w$, $F_R$, and V is different from its value in the basic combination; the two other values are equal to those in the basic combination. Thus it is possible to calculate a basic roll gap variation, as well as the relationships between the roll gap variation and the changes in the rolling force $F_w$, deflecting force $F_R$, and roll shift V, using the four combinations. Consequently, based on the results of these four combinations, the specified rolling force $F_w$*, the specified deflecting force $F_R$*, and the specified roll shift V*, for which the desired roll gap variation arises, are determined through a simple linear combination.

Figure 3:
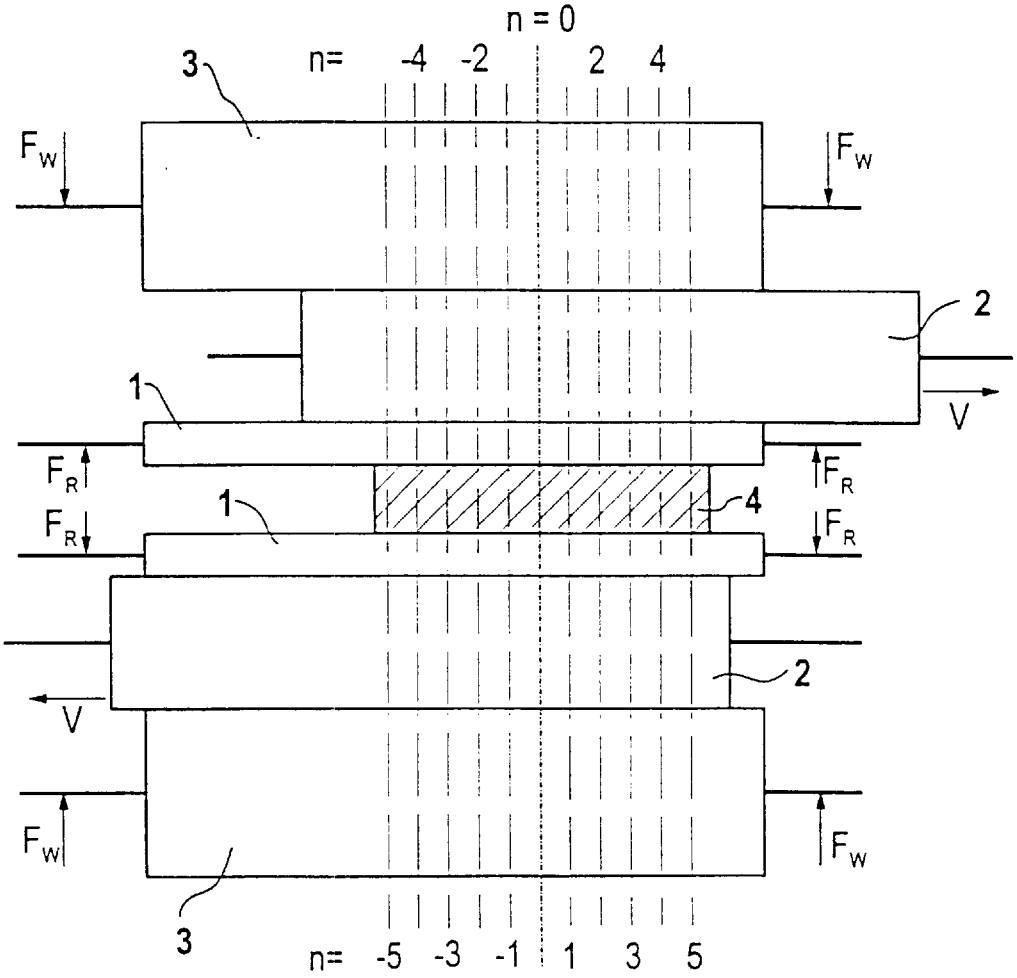
FIG. 3 illustrates interpolation points for calculating the roll gap variation.

The following steps are undertaken in roll deflection model 9 to determine the expected roll gap variation for a given rolling force $F_w$, a given deflecting force $F_R$, and a given roll shift V:

According to FIG. 3, rolls 1 through 3 are divided into individual slices of the same width, with an interpolation point n assigned to the center of each slice. Interpolation points n are on the same axial position for all rolls 1 through 3. The interpolation point in the center of the strip receives the index n=0; interpolation points to the left of it have negative indices n, those to the right have positive indices n.

Then, the assumption $$F_n=F_0+nF_1+\Delta F_n \tag{1}$$

is made for each roll 1 through 3 for the local force $F_n$ acting at each interpolation point n. The sum of the local forces $F_n$ of interpolation points n is equal to the external force acting upon these rolls 1 through 3 in the roll bearings. For work rolls 1, the sum of the local forces $F_n$ is therefore equal to the deflecting force $F_R$, for backup rolls 3 it is equal to the rolling force $F_w$, and for the intermediary rolls 2 it is equal to zero.

Possible assumptions for the variation of forces in the rolls are that ΔF equals 0, that ΔF varies parabolically, or that ΔF varies as a function of empirical values.

The linear component $nF_1$ is first set to zero. A deflection variation $B_n^{1,2,3}$ is calculated separately for each one of rolls 1 through 3 from the above assumption regarding the variation of the local forces $F_n$. The respective differential equations and their solutions are known in principle; therefore, they will not be further discussed here. Deflections $B_n^1$ for the work roll 1, $B_n^2$ for the intermediary roll 2, and $B_n^3$ for the backup roll 3 are obtained at interpolation points n as a result of solving the differential equations. As mentioned before, deflections $B_n^{1,2,3}$ are calculated separately for each of rolls 1 through 3. Consequently, the deflections $B_n^{1,2,3}$ previously calculated at the same interpolation point n can substantially differ from one another. Therefore an additional correction value $\delta f_n$ is calculated for the local forces $F_n$ of two adjacent rolls at interpolation point n. This correction value is calculated from the difference of the deflections of adjacent rolls at the same interpolation point n. The residual correction value $\delta F_n$ is then calculated as $$\delta F_n = k^* f(\Delta F_n, \delta f_n) \quad (2)$$

where k is a gain factor, which initially has the value 1, and f is a deflection-dependent function value.

The residual correction value $\delta F_n$ applies to two adjacent rolls, e.g., backup roll 3 and intermediary roll 2. The residual correction value $\delta F_n$ has a positive sign for one roll and a negative sign for the other roll. This is apparent considering that the increase in force of one roll must correspond to a loss of force of the other roll. Therefore, the components characterizing the variation of forces $\Delta F_n^2$ and $\Delta F_n^3$ for the intermediary roll 2 and backup roll 3 respectively change to $$\Delta F_n'^2 = \Delta F_n^2 + \delta F_n \quad (3)$$

and $$\Delta F_n'^3 = \Delta F_n^3 F\acute{U} - \delta F_n \quad (4)$$

Since the residual correction values $\delta F_n$ of a roll do not necessarily have to mutually compensate one another, and since the sum of the forces $F_n$ at all interpolation points n of a roll must be equal to the external force (e.g., rolling force $F_w$), a correction value $\delta F_0$ for the constant component $F_0$ can be calculated using this information. Based on the fact that the sum of the local forces $F_n$ is equal to the external force, the following expression is obtained for the interpolation point-independent component $F_0'$ for N interpolation points:

$$F_0' = F_0 - (1/N) \cdot \Sigma \delta F_n \quad (5)$$

Furthermore, in a state of equilibrium, the total moment of each roll in relation to the direction of travel of the rolled stock is equal to zero. Therefore, in order to scale the linear component $nF_1$ of the force variation, each local force $F_n$ of each roll is multiplied by the offset of its interpolation point n in relation to the center of the strip to calculate the local moments, and the antisymmetric component $nF_1$ has a value such that the sum of the local moments for each roll is zero. Consequently, the increase $F_1'$ in the linear component results from $$F_1' = F_1 - \Sigma n \cdot \delta F_n / (N+1)/N \quad (6)$$

Thus, new local forces $F_n'$ equal to $$F_n' = F_0' + nF_1' + \Delta F_n' \quad (7)$$

are obtained. The correction values of the local forces $F_n'$ have a constant component $\delta F_0$, a linear component $\delta F_1$ and a residual correction value $\delta F_n$. The components $\delta F_0$ and $\delta F_1$ are calculated as follows:

$$\delta F_o = F_o' - F_o = (-1/N) \cdot \Sigma \delta F_n \quad (8)$$

and $$\delta F_1 = F_1' - F_1 = -\Sigma n \cdot \delta F_n / (N+1)/N \quad (9)$$

With the new local forces $F_n'$ now calculated, the deflection variations $B_n^{1,2,3}$ of rolls 1 through 3 are calculated at interpolation points n, and new correction values for the local forces $F_n'$ are calculated from the newly calculated deflections $B_n^{1,2,3}$. Of course, the correction values will again have values such that the sum of the correction values and the sum of the local moments for each roll 1 through 3 is zero. Iterations are continued until the difference of the deflections $B_n^{1,2,3}$ at all interpolation points n of all adjacent rolls 1 through 3 has dropped under a preselectable limit value, e.g., 0.1 $\mu$m.

The above-described algorithm converges relatively quickly, since, unlike previously used algorithms, it takes into account that the sum of the internal, or local, forces $F_n$ must always be equal to the external force, and that the sum of the local moments must be equal to zero. Therefore, the algorithm can be used on-line. The algorithm can, however, be made to run even quicker in the following manner.

A characteristic deflection difference D1; is calculated in the first iteration for each adjacent pair of rolls (e.g., backup roll 3 and intermediary roll 2). The characteristic deflection difference D1 can be, for example, the maximum difference in the deflections (with a plus or minus sign) of two adjacent rolls. In the second iteration, a characteristic deflection difference D2 is calculated for the second iteration by the same criterion as in the first iteration. From these two values, an optimized gain factor k can then be calculated for the third iteration by assigning the value D1/(D1−D2) to gain factor k. With the gain factor now optimized, the characteristic deflection difference D3 of the third iteration can be made virtually equal to zero.

Rolls 1 through 3 of roll stand 7 warm up during rolling. Rolls 1 through 3 are also subject to wear. Both phenomena cause deformations in rolls 1 through 3, and, as a consequence of such deformations, changes in the roll gap variation occur. Both temperature and wear depend considerably on the forces applied, i.e., rolling force $F_w$ and deflecting force $F_R$, as well as on the roll shift V. In order to take into account the thermal deformation and roll wear in roll stand model 5, the forces $F_w$ and $F_R$ as well as roll shift V, which are obtained from roll deflection model 9, are transferred on-line to temperature model 10 and wear model 11. The temperature-related and wear-related deformations of rolls 1 through 3 are supplied again to roll deflection model 9. Despite this feedback, models 5, 9, 10, and 11 remain stable. The reason for this is that the reverse effect of temperature model 10 and wear model 11 is delayed.

Particularly in the case of temperature model 10, the short contact time of rolled stock 4 with work roll 3 causes the problem that, on the one hand, the individual slices of the work roll 3 should be subdivided into relatively thin rings, but, on the other hand, the computing capacity is limited. There are two possibilities to solve this problem. One is to use an analytical solution for the heat transfer using well-known differential equations for heat transfer. A secondary solution consists of subdividing the individual slices of work roll 3 into relatively wide rings in the middle and gradually narrowing the rings toward the edges. This solution keeps the computing requirements within limits even for a numerical solution, yet keeps the errors arising due to the numerical approximation small.

When roll stand 7 is started, the thermal deformation is equal to zero. The same is true for the wear of rolls 1 through 3. When the first strips 4 are rolled, the deviation of the actual thermal deformation from the temperature deformation calculated by temperature model 10 is negligible. This applies to an even greater degree to deformations due to wear. Initially, the deviations from the precalculated specified roll gap variation and actual roll gap variation are also almost exclusively due to errors in the deflection model 9. The deviations of the actual roll gap variation from the specified roll gap variation are therefore used for the adaptation of deflection model 9. The adaptation can be carried out in the manner well-known per se.

After the adaptation of deflection model 9, deviations of the actual roll gap variation from the specified roll gap variation can be attributed to errors in temperature model 10 and wear model 11. During the following rolled strips, the wear of rolls 1 through 3 is still negligible. At this time, the deviation of the actual wear and the wear that is precalculated using the wear model is therefore also negligible. The deviations of the actual roll gap variation from the specified roll gap variation are therefore basically attributable to an error in temperature model 10. Thus, after adapting deflection model 9, temperature model 10 can also be adapted in a manner known per se using the deviations of the actual roll gap variation from the specified roll gap variation.

The deviations gradually arising between the actual roll gap variation and the specified roll gap variation after the adaptation of temperature model 10 are then used for the adaptation of wear model 11. Also, in this case the adaptation can be performed in a manner well known per se.

Due to the above-described algorithm of deflection model 9 and temperature model 10, the roll gap variation can be precalculated on-line, meaning that the roll gap variation can be calculated in real time. The method according to the invention thus provides a considerably greater flexibility and universality than did the previous off-line models.

What is claimed is:

1. A method of controlling a roll stand for rolling a strip, wherein the roll stand has at least one pair of work rolls and one pair of back up rolls, and optionally one pair of intermediate rolls, each of the rolls mounted on bearings, wherein the method comprises the steps of:

a) using controls for controlling a rolling force, a deflecting force, and optionally a roll shift in the roll stand;

b) using a roll stand model and a deflection model to generate values for controlling the rolling force, deflecting force, and optionally the roll shift;

c) assigning a specified roll gap variation to the roll stand model and using the roll stand model to calculate from the specified roll gap variation on-line set points for the rolling force, the deflecting force, and optionally the roll shift;

d) wherein the on-line set points for the rolling force, the deflecting force and optionally the roll shift are calculated by calculating relationships between on the one hand rolling force, deflecting force, and optionally roll shift and on the other hand a corresponding roll gap variation, on-line at a plurality of interpolation points, the relationships being determined by the steps of:

e) establishing along an axis of each roll a number of interpolation points, wherein corresponding interpolation points are arranged at the same axial position on each roll;

f) obtaining a local force at each interpolation point of each roll, wherein the sum of the local forces of each roll is equal to the outside force acting on the bearings of that roll;

g) calculating at each interpolation point of each roll a deflection based on the local force corresponding to each interpolation point of each roll; and h) calculating a correction value for each of the local forces of neighboring rolls at each interpolation point from the deflections on neighboring rolls at each interpolation point.

2. The method of controlling a roll stand according to claim 1, wherein i) each of the correction values includes a component independent of the interpolation point, and j) the component independent of the interpolation point has a value such that the sum of the correction values for each roll is zero.

3. The method of controlling a roll stand according to claim 2, further comprising the step of:

k) calculating a plurality of local moments, by multiplying each local force by an offset corresponding to the location of the interpolation point in relation to a center of the strip, l) wherein each of the correction values includes a linear component that is antisymmetric in relation to the center of the strip, and m) wherein each linear component has a value such that the sum of each of the local moments of each roll is zero.

4. The method according to claim 1, wherein the steps g) and h) are repeated until a difference of the deflections drops below preselected thresholds at all the interpolation points at all neighboring rolls.

5. The method according to claim 2, wherein the steps g) through j) are repeated until a difference of the deflections drops below preselected thresholds at all the interpolation points at all neighboring rolls.

6. The method according to claim 3, wherein the steps g) through m) are repeated until a difference of the deflections drops below preselected thresholds at all the interpolation points at all neighboring rolls.

7. The method according to claim 3, wherein:

a residual correction value remaining after deducting the component independent of the interpolation point and optionally the antisymmetric component is calculated from a gain factor and a deflection-independent function value; and an optimized gain factor is calculated from the differences of the deflections of successive iterations.

8. The method according to claim 6, wherein:

a residual correction value remaining after deducting the component independent of the interpolation point and optionally the antisymmetric component is calculated from a gain factor and a deflection-independent function value; and an optimized gain factor is calculated from the differences of the deflections of successive iterations.

9. The method according to claim 1, wherein the rolling force, the deflecting force, and optionally the roll shift are supplied as inputs to an on-line temperature model for calculating thermal deformations of each of the rolls.

10. The method according to claim 9, wherein the calculated thermal deformations are supplied as inputs to the roll deflection model.

11. The method according to claim 1, wherein the rolling force, the deflecting force, and optionally the roll shift are supplied as inputs to an on-line wear model for calculating wear deformations of each of the rolls.

12. The method according to claim 11, wherein the calculated wear deformations are supplied as inputs to the roll deflection model.

13. The method according to claim 1, further comprising the steps of:

determining during the rolling operation a profile of the rolled strip, wherein the profile is used to calculate an actual roll gap variation;

comparing the actual roll gap variation to the specified roll gap variation;

calculating adaption parameters for the deflection model, a temperature model, and a wear model from deviations between the actual roll gap variation and the specified roll gap variation in order to adapt the deflection model, the temperature model, and the wear model to actual characteristics of the roll stand; and wherein, after start up of the roll stand, the adaption parameters for the deflection model are calculated first, then the adaption parameters for the temperature model and the wear model are calculated.

14. The method according to claim 1, further comprising the steps of:

determining a distribution of tension across the strip;

determining a corrected specified rolling force, a corrected specified deflecting force, and optionally a corrected specified roll shift from the distribution of tension across the strip;

supplying the corrected specified rolling force, the corrected specified deflecting force, and optionally the corrected specified roll shift to the roll stand controls.

* * * * *